US009658021B2

(12) United States Patent
Brooker

(10) Patent No.: US 9,658,021 B2
(45) Date of Patent: May 23, 2017

(54) MANDREL BASED HELICAL PULL THROUGH GUN CLEANING DEVICE

(71) Applicant: Otis Products, Inc., Lyons Falls, NY (US)

(72) Inventor: James R. Brooker, Constantia, NY (US)

(73) Assignee: Otis Products, Inc., Lyons Falls, NY (US)

( * ) Notice: Subject to any disclaimer, the term of this patent is extended or adjusted under 35 U.S.C. 154(b) by 0 days.

(21) Appl. No.: 15/013,309

(22) Filed: Feb. 2, 2016

(65) Prior Publication Data

US 2016/0223283 A1 Aug. 4, 2016

Related U.S. Application Data

(60) Provisional application No. 62/111,391, filed on Feb. 3, 2015.

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02
See application file for complete search history.

(56) References Cited

U.S. PATENT DOCUMENTS 387,410 A 8/1888 Gillette
1,373,999 A * 4/1921 Cochran ..... F41A 29/02 15/104.165
1,555,460 A * 9/1925 Cotta ..... F41A 29/02 15/104.16
4,716,673 A * 1/1988 Williams ..... F41A 29/02 15/104.16
7,367,151 B1 * 5/2008 Black ..... F41A 29/00 15/104.05
8,176,592 B1 * 5/2012 Carpenter ..... B08B 9/00 15/104.16
8,695,264 B1 * 4/2014 Blackburn ..... F41A 29/02 42/95

(Continued)

OTHER PUBLICATIONS

ISA/US International Search Report and Written Opinion for corresponding International Application No. PCT/US2016/016324, date of mailing Apr. 14, 2016 (7 pgs).

*Primary Examiner* — Stephen M Johnson
*Assistant Examiner* — Joshua Semick
(74) *Attorney, Agent, or Firm* — Harris Beach PLLC

(57) ABSTRACT

A pull through gun cleaning device includes a mandrel with a spiral or helical trough disposed in an outer cylindrical surface of the mandrel. A pull cord includes a cable member covered by a tubular woven sheath. The pull cord is threaded through a tunnel at the first end of the mandrel, wrapped around the mandrel in the spiral or helical trough disposed in an outer cylindrical surface of the mandrel and threaded through a tunnel at the second end of the mandrel to form a mandrel cleaning section. An outside diameter of the mandrel cleaning section is configured such that where the mandrel cleaning section is inserted into one end of the barrel the mandrel compresses to provide a radial force pressing the tubular woven sheath of the pull cord against an inside surface or a rifling of the barrel.

19 Claims, 9 Drawing Sheets

(56) References Cited

U.S. PATENT DOCUMENTS

| | | | | |
|---|---|---|---|---|
| 8,793,918 | B2 * | 8/2014 | Rogers | F41A 29/02 15/104.16 |
| 9,115,945 | B2 * | 8/2015 | Williams | B08B 9/0436 |
| 9,228,790 | B2 * | 1/2016 | Stephens | F41A 29/02 |
| 2004/0111948 | A1 * | 6/2004 | Schnell | F41A 29/02 42/95 |
| 2016/0223282 | A1 * | 8/2016 | Brooker | F41A 29/02 |

* cited by examiner

MANDREL BASED HELICAL PULL THROUGH GUN CLEANING DEVICE

CROSS-REFERENCE TO RELATED APPLICATIONS

This application claims priority to and the benefit of co-pending U.S. provisional patent application Ser. No. 62/111,391, MANDREL BASED HELICAL PULL THROUGH GUN CLEANING DEVICE, filed Feb. 3, 2015, which application is incorporated herein by reference in its entirety.

FIELD OF THE APPLICATION

The invention relates to a gun cleaning tool, and particularly to a pull through gun cleaning tool.

BACKGROUND

Barrels of firearms are difficult to clean. Carbon and other residue from gunpowder and from firearm discharge reactions accumulate in firearm barrels, with deleterious effects on cleanliness, performance, and longevity of the firearm. Such residues require partial disassembly of a weapon to access and clean the barrel and associated firing chamber. A number of specialized swabbing, brushing and scraping tools have been introduced to clean firearm components, but have had substantial shortcomings.

SUMMARY

According to one aspect, a pull through gun cleaning device includes a mandrel with a spiral or helical trough disposed in an outer cylindrical surface of the mandrel and a tunnel disposed at about each of a first end of the mandrel and a second end of the mandrel, the tunnel having an angle with respect to a central axis of the mandrel. A pull cord includes a cable member covered by a tubular woven sheath. The pull cord is threaded through the tunnel at the first end of the mandrel, wrapped around the mandrel in the spiral or helical trough disposed in an outer cylindrical surface of the mandrel and threaded through the tunnel at the second end of the mandrel to form a mandrel cleaning section. The pull cord extends on at least one side of the mandrel cleaning section a length beyond the mandrel cleaning section to serve as a pull cord of the pull through gun cleaning device. A total length of the pull cord is configured such that where the mandrel cleaning section is inserted into one end of a barrel of a weapon for which the pull through gun cleaning is adapted to clean, the pull cord extends past another end of the barrel. An outside diameter of the mandrel cleaning section is configured such that where the mandrel cleaning section is inserted into one end of the barrel the mandrel compresses to provide a radial force pressing the tubular woven sheath of the pull cord against an inside surface or a rifling of the barrel.

In another embodiment, the mandrel includes a thermosetting rubber polymer or a thermoplastic elastomer.

In yet another embodiment, the mandrel includes a concave section disposed at a longitudinal end of the mandrel between an end of the helical trough and an end face of the mandrel.

In yet another embodiment, the mandrel includes a frustoconical section disposed at a longitudinal end of the mandrel between an end of the helical trough and an end face of the mandrel.

In yet another embodiment, the spiral or helical trough includes a trough selected from the group consisting of a U shaped trough, a V shaped trough, a rectangular shaped, a concave shape, and a rounded shape trough.

In yet another embodiment, the cable member includes a coated cable.

In yet another embodiment, the coated cable includes a coating selected from the group consisting of nylon, vinyl, and plastic.

In yet another embodiment, the cable member includes a steel wire.

In yet another embodiment, the tubular woven sheath includes a natural fiber.

In yet another embodiment, the tubular woven sheath includes a synthetic fiber.

In yet another embodiment, the tubular woven sheath includes a fiber selected from the group consisting of a heat resistant material, a meta-aramid, a NOMEX, a para-aramid, a KEVLAR™, a fiberglass, and a K-fiber.

In yet another embodiment, the tubular woven sheath includes a fiber selected from the group consisting of a nylon, a polystyrene, an acetal, an acrylic, a metallic thread, and a brass metallic thread.

In yet another embodiment, the tubular woven sheath includes a phosphorescent thread or a luminescent thread.

In yet another embodiment, the gun cleaning device further includes a fitting disposed at one or both ends of the gun cleaning device.

In yet another embodiment, the gun cleaning device further includes a T-handle mechanically coupled to an end of the cable member by the fitting.

In yet another embodiment, the gun cleaning device further includes an accessory swab attachment mechanically coupled to an end of the cable member by the fitting.

In yet another embodiment, the gun cleaning device further includes an accessory brush attachment mechanically coupled to an end of the cable member by the fitting.

In yet another embodiment, the gun cleaning device further includes an accessory scraper attachment mechanically coupled to an end of the cable member by the fitting.

The foregoing and other aspects, features, and advantages of the application will become more apparent from the following description and from the claims.

BRIEF DESCRIPTION OF THE DRAWINGS

The features described herein can be better understood with reference to the drawings described below. The drawings are not necessarily to scale, emphasis instead generally being placed upon illustrating the principles of the invention. While the particular embodiments are described in relation to cleaning the interior of a gun barrel, individuals skilled in the art will recognize and understand that the disclosure and embodiments herein are equally applicable to cleaning pipes, conduits and tubing that is both straight and curved. In the drawings, like numerals are used to indicate like parts throughout the various views.

DETAILED DESCRIPTION

A system and tool for cleaning the interior of tubular members is described hereinbelow. In one embodiment, a cleaning device includes a cable member supporting a region of overmolded elastomer around the cable core. The system can also include a tubular woven sheath surrounding at least a portion of the overmolded elastomer. The cable member can include a fitting at one end and preferably at both ends for attachment to any of various auxiliary tools such as swabs, brushes, scrapers, handles, adapters and the like. The system and tools described herein are suitable for the cleaning of the barrels of firearms, such as the barrels of rifles, carbines, pistols.

Other types of pull through gun cleaning devices have been described, such as, for example, in co-pending U.S. patent application Ser. No. 13/785,966, APPARATUS AND METHOD FOR CLEANING THE BARREL OF A FIREARM filed Mar. 5, 2013, and co-pending U.S. patent application Ser. No. 14/076,713, APPARATUS AND METHOD FOR CLEANING THE BARREL OF A FIREARM filed Nov. 11, 2013, and co-pending U.S. Patent Application Ser. No. 62/111,315, HELICALLY WOUND PULL THROUGH GUN CLEANING DEVICE, filed Feb. 3, 2015, and co-pending U.S. Patent Application Ser. No. 62/111,445, PULL THROUGH GUN CLEANING DEVICE WITH ONE OR MORE CYLINDRICAL DOUBLE CONED SHEATHED PRESSURE SECTIONS, filed Feb. 3, 2015, all applications also assigned to the present assignee, Otis Products, Inc. All of the above named applications are incorporated herein by reference in their entirety for all purposes.

Figure 1:
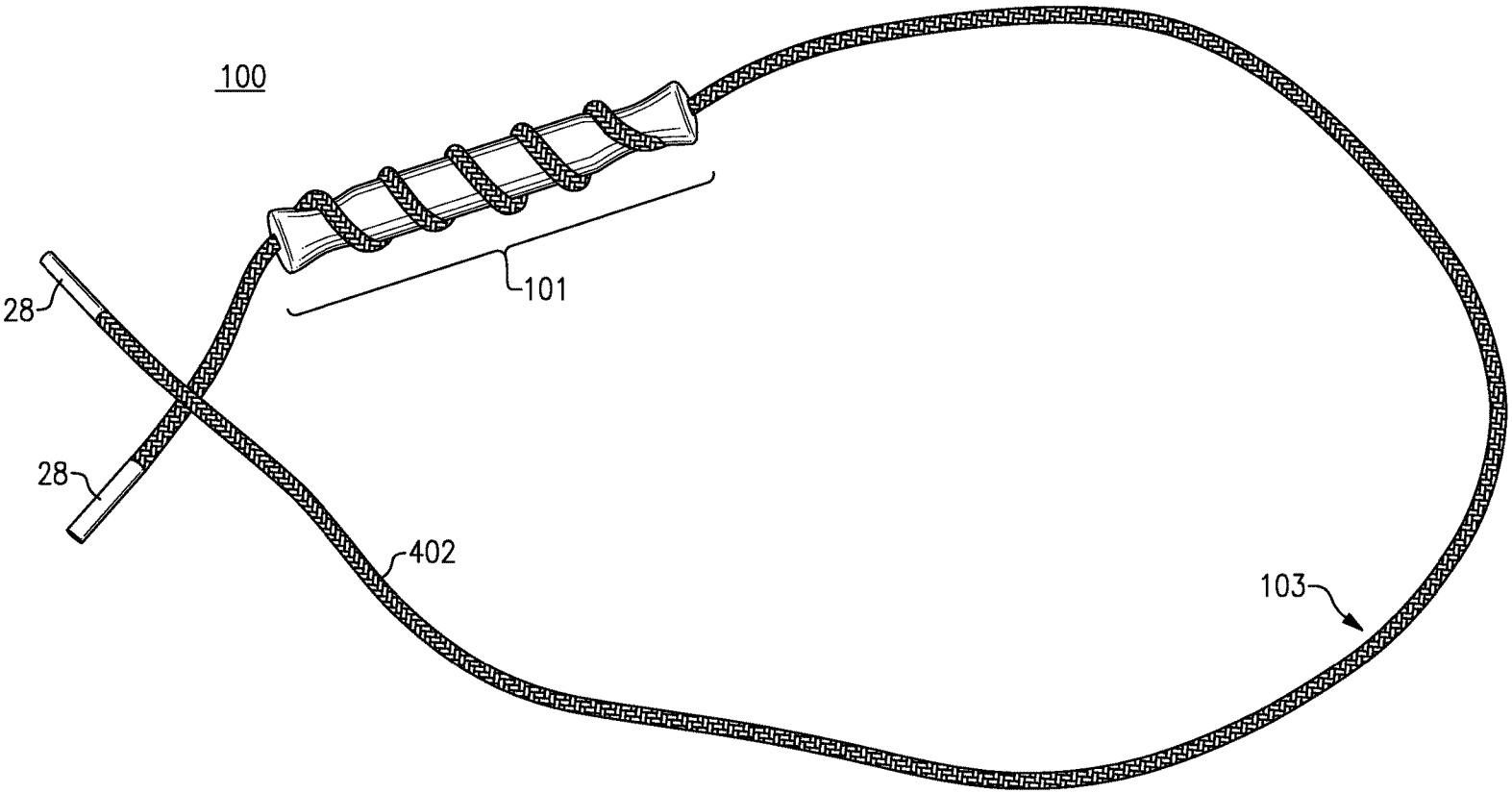
FIG. 1 shows an illustration of one exemplary mandrel based pull through gun cleaning tool.

FIG. 1 shows an illustration of one exemplary mandrel based pull through gun cleaning tool 100. A pull through pull cord 103 is covered, such as, for example, by a woven fabric sheath 402. The pull cord 103 is wound around a mandrel to form a mandrel cleaning section 101. Mandrel cleaning section 101 has an outside diameter, including the added width of pull cord 103 with its woven fabric sheath 402, such that the mandrel cleaning section 101 can fit conformingly to the inside diameter of the bore of a barrel of a weapon, such as for example, the bore of a shot gun. Typically, the mandrel can be sized to near optimally clean the inside wall and/or rifling of the barrel of a weapon.

Figure 2A:
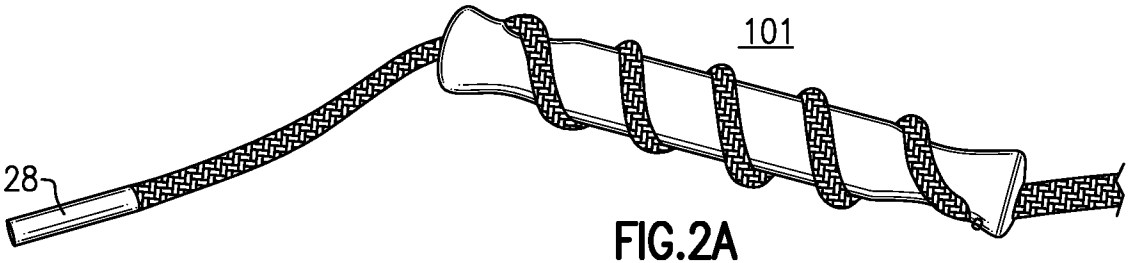
FIG. 2A shows a more detailed view of the mandrel cleaning section of FIG. 1.

FIG. 2A shows a more detailed view of the mandrel cleaning section 101 of FIG. 1, including a fitting 28 which can be a threaded fitting adapted to accept various accessory tools, as described in more detail hereinbelow.

Figure 2B:
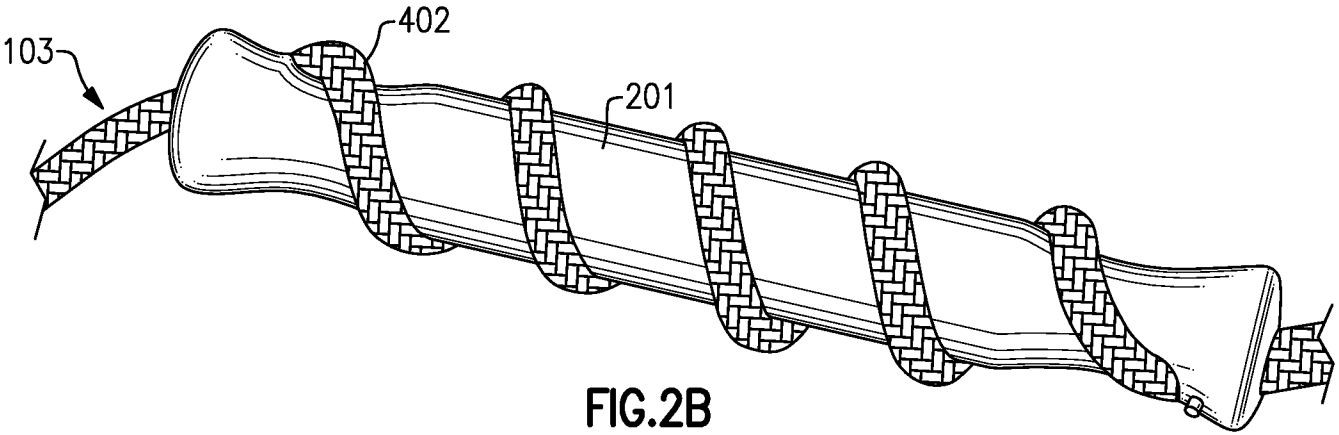
FIG. 2B shows yet a further detailed view of the mandrel cleaning section of FIG. 2A.

FIG. 2B shows yet a further detailed view of the mandrel cleaning section 101 of FIG. 2A which shows the pull cord 103 with its woven fabric sheath 402 wound securely over a mandrel 201.

Mandrel 201 can be formed of any suitable material, such as, for example wood or plastic, such as, a thermoplastic. Mandrel 201 can be formed from a thermoplastic by any suitable thermoplastic manufacturing technique, such as, for example, thermoplastic molding. The mandrel can be made from any suitable material, typically a material that offers some compressibility so that once compressed the combination of the compressed sheath and cylindrical double coned sheathed pressure sections provide an outward pressure perpendicular to the center line of the bore so as to force the cleaning sheath against the interior surface of the bore (smooth or rifled) so that the sheath is forced against the interior surface as the sheathed cylindrical double coned pressure sections are pulled through the barrel. For example, the mandrel can be formed of a thermosetting rubber polymer, such as by injection molding onto the coating 502 of the central member defined by coating 502 over wire rope 501 of the pull cord 103. Any suitable material, such as for example, any suitable thermoplastic elastomer can be used.

On advantage of a slightly compressible mandrel (e g a mandrel formed from a thermoplastic) is that it can be slightly compressed as it is inserted into the bore of a weapon (e.g. into the barrel of a rifle) so as to cause the pull cord 103 with its woven fabric sheath 402 to push out radially (perpendicular to a longitudinal axis of the mandrel cleaning section 101) against the inner surface and or inner rifling of the bore of the weapon.

Figure 3:
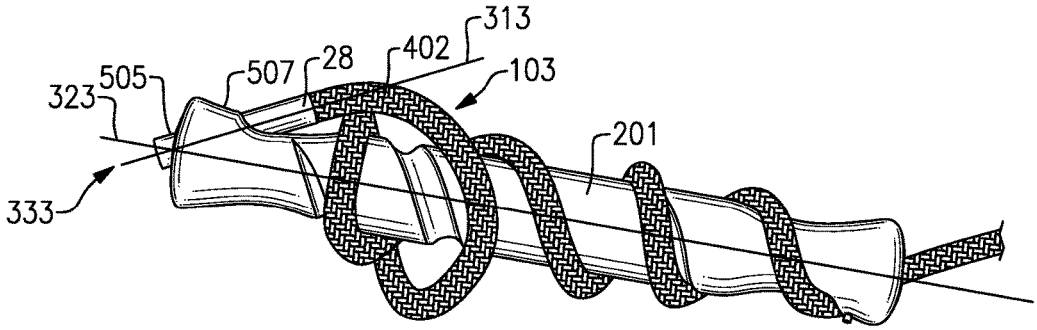
FIG. 3 shows the mandrel of FIG. 2B with the cable member loosened from the mandrel.

FIG. 3 shows the mandrel 201 of FIG. 2B with the pull cord 103 loosened from the mandrel 201. The pull cord 103 can be seen to be threaded through opening 507 and opening 505 on the left side of mandrel 201. The pull cord 103 has been loosened from the mandrel 201 by pulling the pull cord out of opening 507 and opening 505 in a sliding motion through a channel in mandrel 201 defined by opening 507 and opening 505 in mandrel 201.

Figure 4:
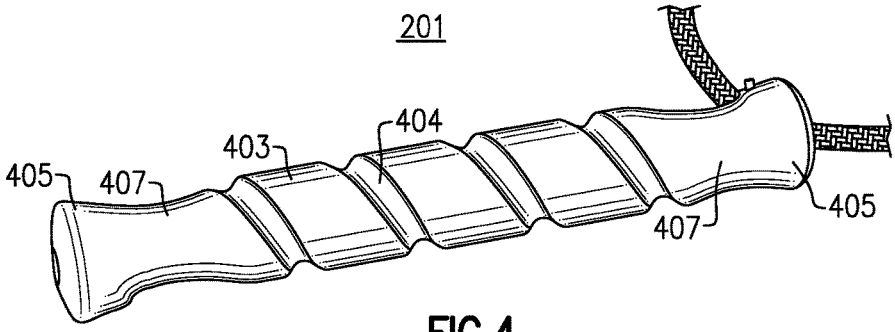
FIG. 4 shows an illustration of the mandrel of FIG. 3 with the cable member mostly off of the surface of mandrel exposing the mandrel.

FIG. 4 shows an illustration of the mandrel 201 of FIG. 3 with the pull cord mostly off of the surface of mandrel 201 to expose the physical features of this exemplary embodiment of a mandrel 201. Mandrel 201 includes a spiral or helical trough 404 and complimentary spiral or helical flat sections 403 disposed between the trough 404. Spiral or helical trough 404 can have any suitable pitch angle $\measuredangle P$. Complimentary spiral or helical flat sections 403 can be a substantially flat cylindrical surface in which spiral or helical trough 404 is formed, thermoformed, machined, or cut. Spiral or helical trough 404 can be of any suitable trough shape including, for example, U shaped, V shaped, rectangular shaped, a concave shape, or a rounded shape. There can also be more or more additional interleaved spiral or helical troughs.

At either end of mandrel 201 are concave dips 407 which are generally cylindrically symmetric as the come off the ends of the spiral or helical trough 404 and complimentary spiral or helical flat sections 403 disposed between the troughs 404 at either side of mandrel 201. Outside of each of the concave dips 407 with respect to the longitudinal axis 323 (FIG. 3) of the mandrel 201 are frustoconical sections 405 disposed towards either of the end most sections of mandrel 201.

Figure 5:
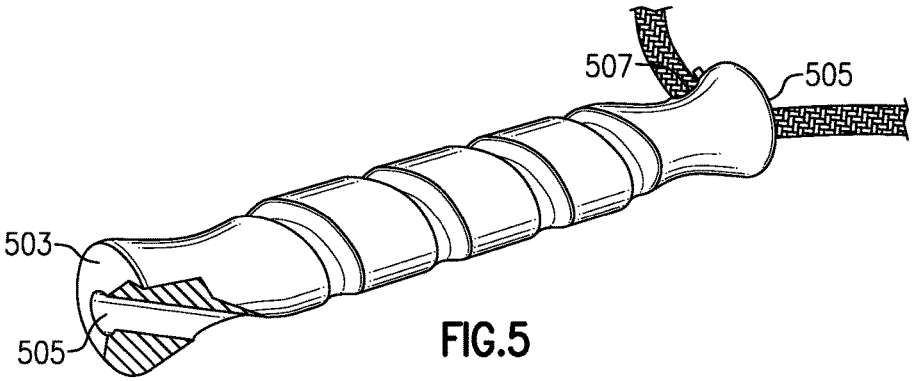
FIG. 5 shows another view the mandrel illustrating openings in the end face of each side of the mandrel which define the ends of tunnels.

FIG. 5 shows another view the mandrel 201 illustrating the openings 505 in the end face 503 of each side of the mandrel 201 as well as the opening 505 on both sides of mandrel 210 (only the right side opening 505 visible in FIG. 5) which define tunnels 333 (FIG. 3).

Now, turning back to FIG. 3 and FIG. 4, in some embodiments, a pull through gun cleaning device 100 includes a mandrel 201. Mandrel 201 includes a spiral or helical trough 404 disposed in an outer cylindrical surface of the mandrel 201 and a tunnel 333 disposed at about each of a first end of the mandrel and a second end of the mandrel 201, the axis each of the tunnels 313 having a tunnel angle ∡T with respect to a central axis of the mandrel 323. A pull cord 103 includes a tubular woven sheath 402. The pull cord 103 is threaded through the tunnel 333 at the first end of the mandrel, wrapped around the mandrel 201 in the spiral or helical trough 404 disposed in an outer cylindrical surface 403 of the mandrel 201 and threaded through the tunnel 333 at the second end of the mandrel to form a mandrel cleaning section 101. The pull cord extends on at least one side of the mandrel cleaning section a length beyond the mandrel cleaning section (FIG. 1) to serve as a pull cord of the pull through gun cleaning device. A total length of the pull cord is configured such that where the mandrel cleaning section is inserted into one end of a barrel of a weapon for which the pull through gun cleaning is adapted to clean. The pull cord extends past another end of the barrel. An outside diameter of the mandrel cleaning section is configured such that where the mandrel cleaning section is inserted into one end of the barrel the mandrel compresses to provide a radial force pressing a sheath of the pull cord against an inside surface or a rifling of the barrel (FIG. 12).

Figure 12:
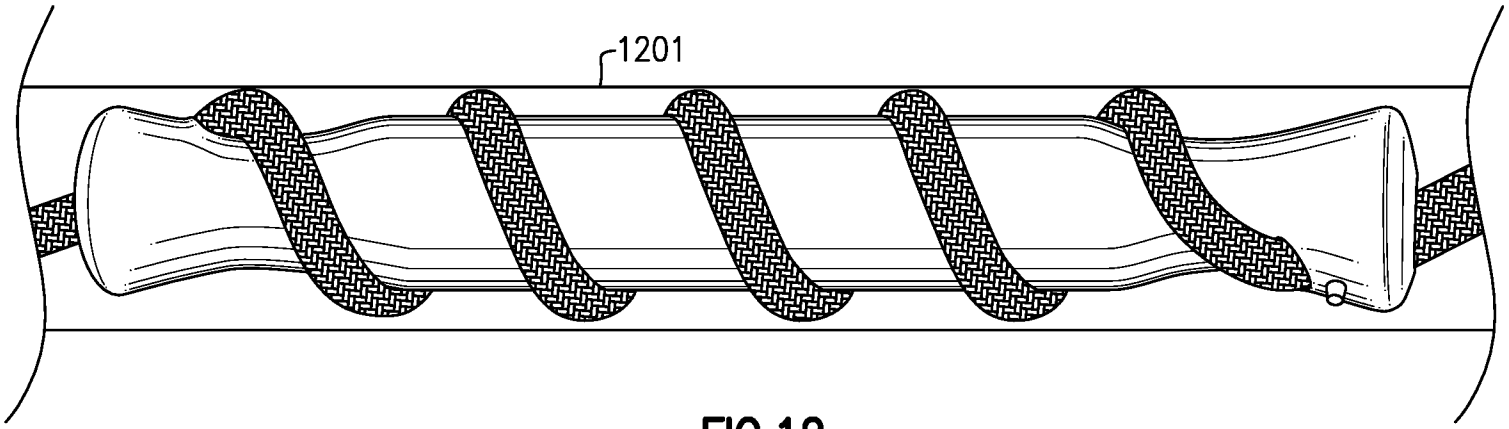
FIG. 12 shows a contemplated view of the exemplary mandrel based pull through gun cleaning tool of FIG. 1 inside a shotgun barrel.

FIG. 12 shows a contemplated view of the exemplary mandrel based pull through gun cleaning tool of FIG. 1 inside a shotgun barrel.

Figure 6A:
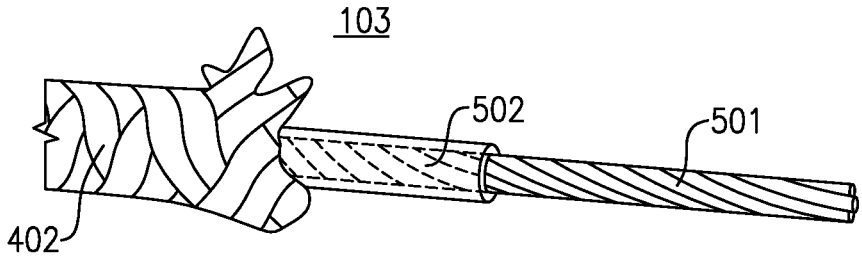
FIG. 6A shows an illustration of an exemplary coated cable central member.
Figure 6B:
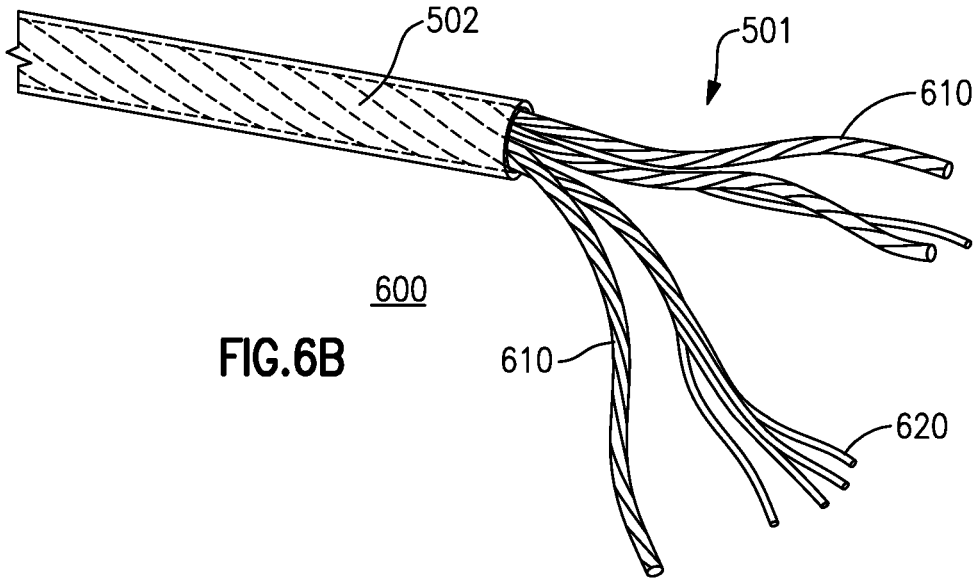
FIG. 6B shows an illustration of the stranding of the wire rope of the coated cable member of FIG. 6A.

FIG. 6A shows an illustration of an exemplary coated cable central member. Wire rope 501 is typically formed from a plurality of strands or bundles, each bundle having a plurality of wires. The coating 502 can be formed form any suitable material, such as, for example, nylon, vinyl, plastic, or any other suitable material which can accept a helical over-mold 410. FIG. 6B shows an illustration of the stranding of the wire rope of the coated cable member 600 of FIG. 6A. The exemplary cable member 600 coated cable 501 of FIG. 6B has a coating 502 over 5 bundles of 7 wires each. Typically the wires are made from steel, such as, for example, stainless steel, galvanized steel, or zinc coated steel. The cable member 600 coated cable 501 can be, for example, a pre-assembled coated aircraft cable wire, or any other suitable commercially available pre-assembled coated cable wire which is well-known in the art.

Example: The following prototype mandrel based pull through gun cleaning tool was manufactured. The exemplary tool was about 30" long. The mandrel was about 4.7" long and about 0.6" in diameter (uncompressed by the barrel of a weapon). The trough was about 0.13" deep. There were about four spiral turns from end to end. The pitch angle ∡P of the turns was about 65° with respect to the longitudinal axis of the mandrel. The tunnel angle ∡T was about 30° with respect to the longitudinal axis of the mandrel.

The pull cord, or long straight section was about 0.15" in diameter including the tubular woven sheath over the coated cable. The helical over-mold with roughly an elliptical cross section was about 0.38"×0.26" (including ridges and troughs). The cable member 600 had a diameter of the cable coating of about 0.094" and a diameter of the wire rope of about 0.065". The wire rope was made from 5 bundles of 7 zinc plated wires, each wire having a diameter of about 0.007".

While the exemplary embodiments described hereinabove are based on a coated wire cable, the cable member 600 can comprise any suitable material or elongate form, e.g., fiber rope or cord, rod, wire, or twisted or braided cable and can be rigid, semi-rigid or semi-flexible. The rigid or semi-rigid structure of a helically wound pull through gun cleaning device makes it an excellent gun barrel obstruction remover. In some embodiments, the cable member 600 can have sufficient rigidity to be easily threaded or passed through the tubular member. A wire cable as described hereinabove can also be formed of a metal such as galvanized steel, preferably formed to have a natural curl for ease of laterally coiling in storage and preferably having a protective plastic coating. The protective plastic coating reduces the risk of scratching gun components and the potential for fraying of the cable. With respect to the cleaning of tubular members other than gun barrels, a semi-rigid structure of the core can accommodate some slight or eventual curves in the interior of a pipe, conduit or tube. However, a semi-flexible core member is preferable for cleaning sections of pipe, conduit or tubes having substantially curved shapes and turns between straight segments of tubular members.

Figure 7:
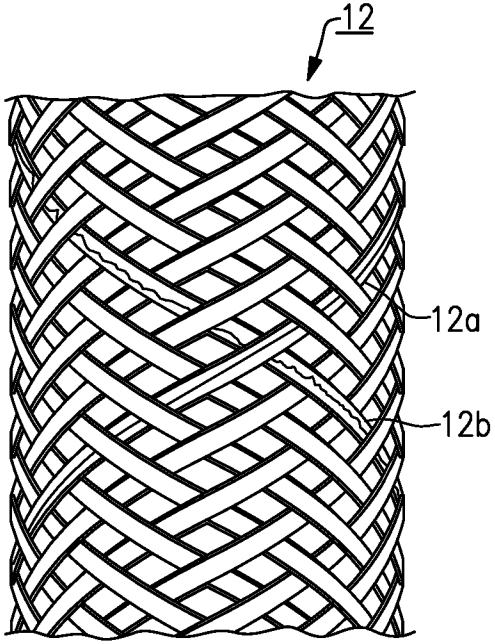
FIG. 7 is an elevational view of a portion of a tubular woven sheath in accordance with the present invention.

FIG. 7 shows an exemplary tubular woven sheath. Sheath 12 can be woven of primarily a natural fiber such as cotton, although synthetic fiber can be included; and 100% synthetic fiber is fully comprehended by the invention. Many natural fibers are sufficiently absorbent to retain adequate amounts of cleaning solvent without the need for sections of additional absorbent sponges between the sheath and the core. Additional special-purpose threads, such as fiber-optic 12*a*, phosphorescent or luminescent threads 12*b*, can also be woven into the sheath to provide, for example, auxiliary lighting for visual inspection of a gun barrel for cleanliness as tool 10 is withdrawn. In another aspect of the invention, the woven sheath can comprise fibers of heat resistant materials, such as meta-aramids, NOMEX, para-aramids, KEVLAR, fiberglass, K-fiber, or the like. In another aspect of the invention, synthetic fibers, such as nylon, polystyrene, acetals, acrylics or the like, or metallic thread, such as brass or the like, can be incorporated into the sheath to increase the abrasive characteristic of the sheath to assist in removal stubborn residue from the barrel. Sheath 12 can be woven, for example, on a tubular commercially available braiding machine Where the sheath is comprised of heat resistant fibers or materials, cleaning of the sheath can also be performed by the application of sufficient heat to burn off the accumulated residue. For example, the tool 10 or the sheath 12 could be placed in an oven at a temperature below the melting or deformation temperature of the fibers such that any dirt or carbon residue detaches from the fibers of the sheath.

Figure 8:
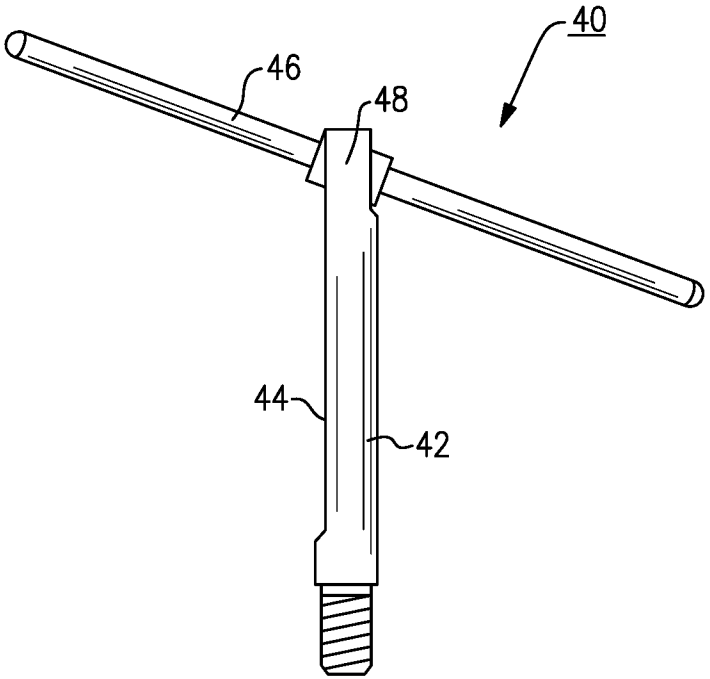
FIG. 8 is an elevational view of a foldable T-handle, also referred to interchangeably herein as a "pull-through handle tool", formed for passage in folded configuration through the barrel of a weapon.

Referring now to FIG. 8, an exemplary foldable T-handle 40, comprising a threaded shaft 42 having a longitudinal well 44 and a pivotable handle 46 attached to shaft 42 by pin 48 formed for passage in folded configuration through the bore of a weapon, is attachable to either of fittings 28, either before or after passage through a gun barrel of a leading end of apparatus 10, to assist a user in pulling apparatus 10 through a gun barrel. Where embodiments of the invention are used to clean the interior of tubular members having curved shapes, the T-handle is preferably attached to the fitting at the leading end of the pull cord after it is threaded through the tubular member. Where the interior of the tubular member is straight, a slim profile T-handle can be attached to the fitting at the leading end of the central member, or can be integrated with the fitting at the leading end of the central member. An exemplary slim profile T-handle is disclosed in U.S. patent application Ser. No. 13/448,973 entitled "Firearm Pull-Through Cleaning Tool with Integrated Foldable Handle," filed on Apr. 17, 2012 assigned to the common assignee of this application, which is hereby incorporated by reference in its entirety.

Figure 9:
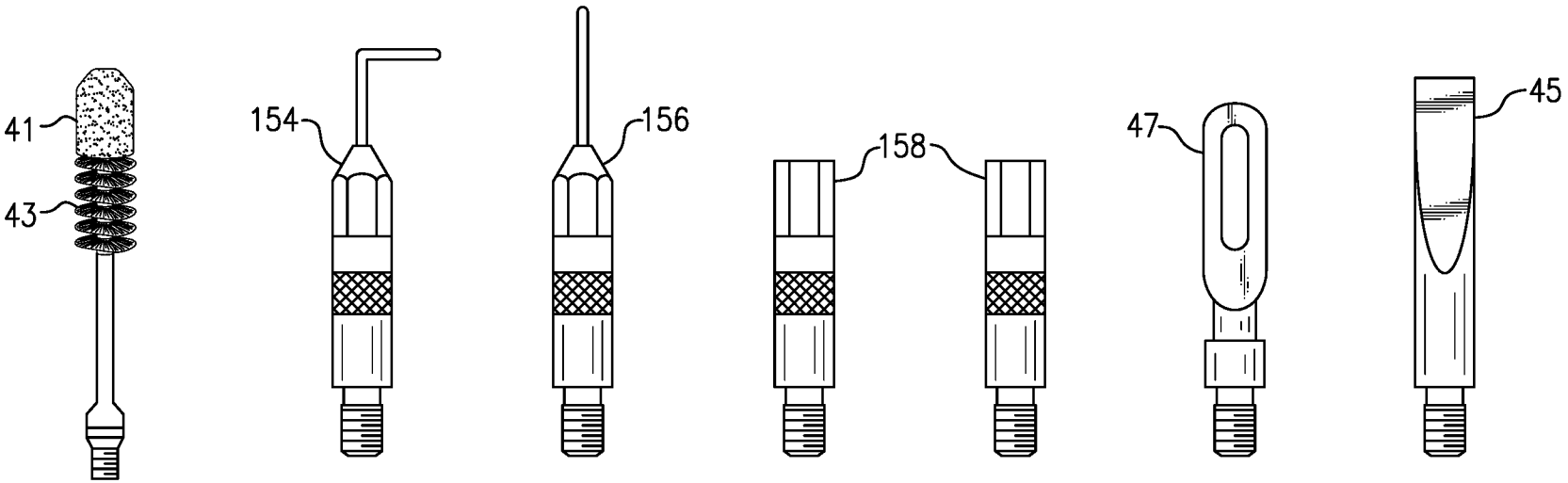
FIG. 9 depicts an assortment of typical auxiliary tools adapted to attach to the fittings at the end of the central member.
Figure 10A:
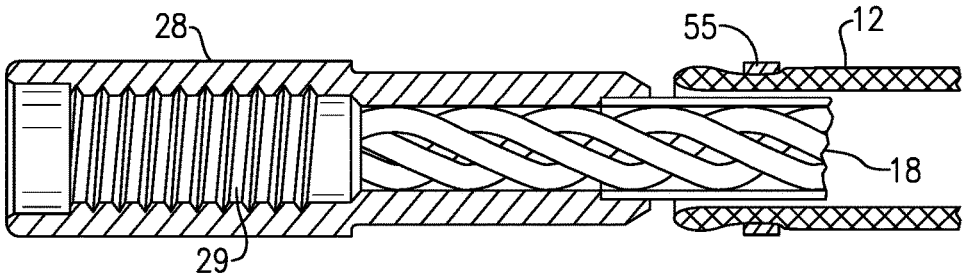
FIG. 10A depicts a crimping ring retaining the tubular woven sheath on the central member.
Figure 10B:
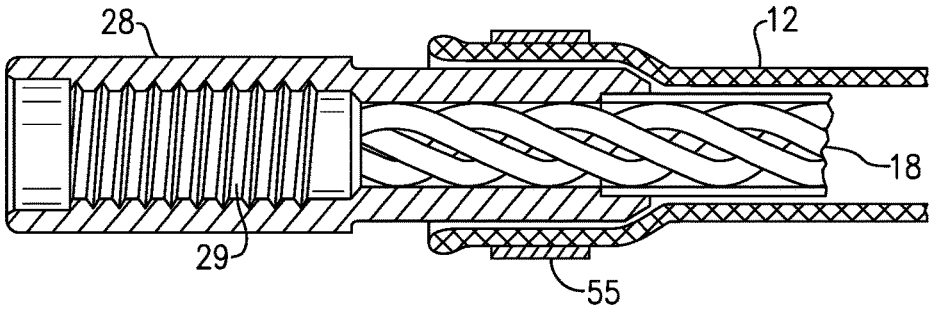
FIG. 10B depicts another embodiment wherein the crimping ring retains the sheath against a fitting at the end of the central member.

With reference to FIG. 9, FIG. 10A and FIG. 10B, cable member 18 preferably includes a fitting 28 at one end, and preferably at both ends, for attachment to any of various auxiliary tools such as swabs 41, brushes 43, scrapers 45, tips 47, a T-handle 51, and the like, as well as a cable extender and/or serially connection additional gun barrel cleaning tools 10. The fittings can be crimped, bonded or cold welded to the end of the central member. The fittings 28 can have internal or external threads 29 or other quick connect mechanisms to couple with the fittings of the auxiliary tools as depicted in FIG. 9.

Figure 11:
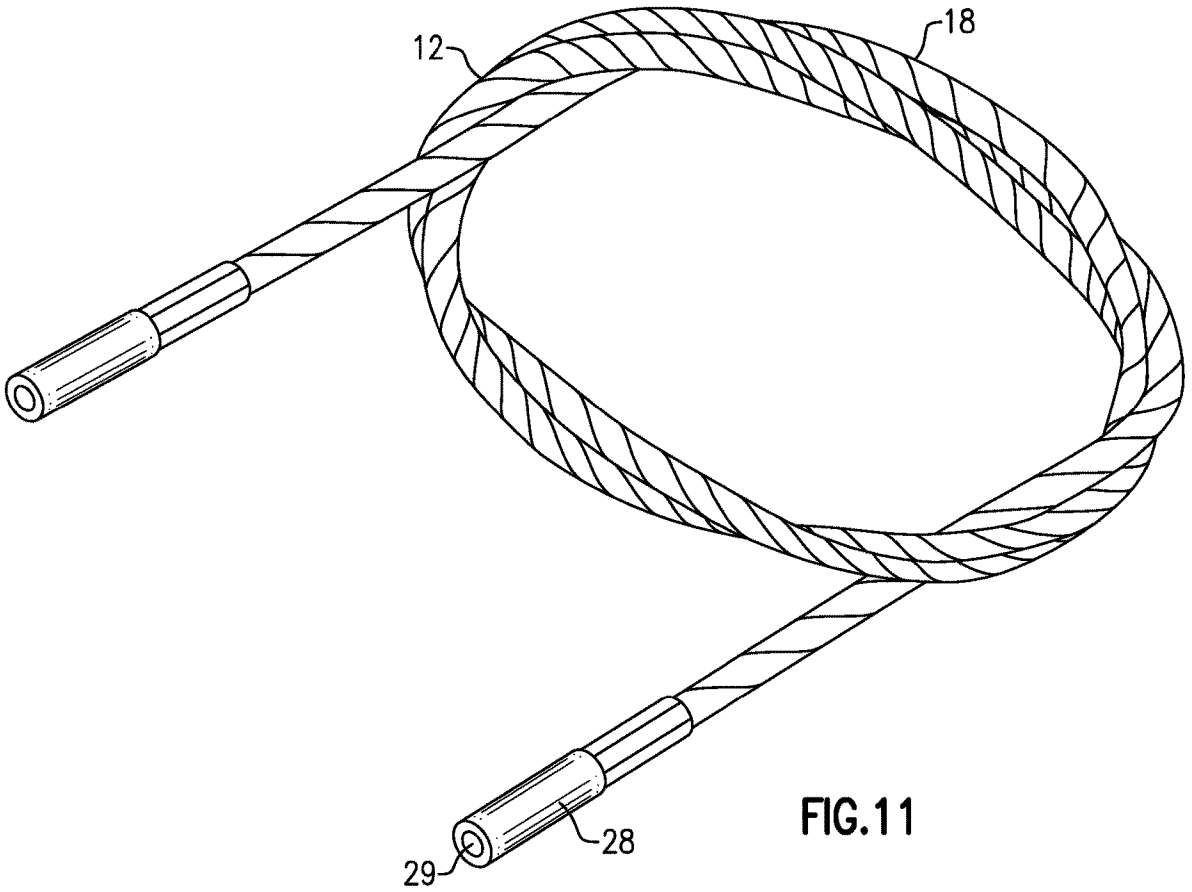
FIG. 11 depicts an embodiment of a cable member having fittings on the leading and trailing ends thereof in a coiled position.

FIG. 11 depicts an embodiment of a cable member having fittings on the leading and trailing ends thereof in a coiled position. While not showing a helically wound pull through gun cleaning device, FIG. 11 shows how fitting can be affixed to either or both ends of a helically wound pull through gun cleaning device. In some embodiments, the fittings 28 can also be sized and configured to attach one or both of the leading or trailing end of the sheath to the central member. Alternatively, as depicted in FIG. 10A and FIG. 10B, a separate crimping ring 55 or other suitable connector can be utilized over the sheath 12 and the cable member 18 or the fitting 28 to retain the edge of the sheath in place over the central core 18 and the sheath 12. In some embodiments, it may be sufficient to crimp over the central core alone.

In some embodiments, the sheath 12 is not connected to the fittings or cable member 18, but held in place by the tight fit of the woven sheath 12 over any additional protrusions or by the over molded mandrel. In some embodiments, the sheath can be removable from the tool for cleaning to remove build-up of removed residue. The sheath 12 can include elasticized threads to assist in the removal, cleaning and/or replacement of the sheath. Alternatively, cleaning can be accomplished by soaking the coiled tool in a suitable detergent solution and rinsed to remove the accumulated build-up of dislodged residue.

The respective thicknesses of the central core, protective layer, overmolded protrusions, absorbent materials and the woven sheath can be varied to change the radial width of the tool to fit the gun barrels of differing calibers. Alternatively, the compressibility of any of the over-molded protrusions or an over molded mandrel, absorbent material and/or the woven sheath can also be increased so that a single tool can appropriately clean a range of calibers of gun barrels.

In some embodiments, the natural fibers of the sheath and any absorbent material disposed beneath the sheath or at the trailing end of the cable member can be used to absorb and remove spent cleaning fluids containing dislodged residue. However, the overmolded thermoplastic region has been successfully deployed to clean a variety of relatively narrow tubular members without a sheath. A plurality of protrusions, including particularly, any additional protrusions (e.g. helical protrusions), or the mandrel over-mold is effective at removing liquids and semi-solids such as grease and congealed oils, from narrow drains. A plurality of protrusions, such as, for example, ridges of the helical over-mold can wipe excess accumulations of liquids and semi-solids in the manner of a squeegee from the interior of a pipe or drain. Even where a pipe or drain includes a catch or other curved portion, embodiments of the invention utilizing a semi-flexible cable member were threaded through the drain and pulled through the tubular member. This embodiment removed excess accumulations of grease and spent oils in a small fraction of the time of other common methods.

It will be appreciated that variants of the above-disclosed and other features and functions, or alternatives thereof, can be combined into many other different systems or applications. Various presently unforeseen or unanticipated alternatives, modifications, variations, or improvements therein can be subsequently made by those skilled in the art which are also intended to be encompassed by the following claims.

What is claimed is:

1. A pull through gun cleaning device comprising:

a mandrel comprising a spiral or helical trough disposed in an outer cylindrical surface of said mandrel and a tunnel disposed at about each of a first end of said mandrel and a second end of said mandrel, said tunnel having an angle with respect to a central axis of said mandrel;

a pull cord comprising a cable member covered by a tubular woven sheath, said pull cord threaded through said tunnel at said first end of said mandrel, wrapped around said mandrel in said spiral or helical trough disposed in said outer cylindrical surface of said mandrel and threaded through said tunnel at said second end of said mandrel to form a mandrel cleaning section, said pull cord extending on at least one side of said mandrel cleaning section a length beyond said mandrel cleaning section to serve as said pull cord of said pull through gun cleaning device;

wherein a total length of said pull cord is configured such that where said mandrel cleaning section is inserted into one end of a barrel of a weapon for which said pull through gun cleaning device is adapted to clean, said pull cord extends past another end of said barrel; and wherein an outside diameter of said mandrel cleaning section is configured such that where said mandrel cleaning section is inserted into one end of said barrel said mandrel compresses to provide a radial force pressing said tubular woven sheath of said pull cord against an inside surface or a rifling of said barrel.

2. The gun cleaning device of claim 1, wherein said mandrel comprises a thermoplastic.

3. The gun cleaning device of claim 1, wherein said mandrel comprises a thermosetting rubber polymer or a thermoplastic elastomer.

4. The gun cleaning device of claim 1, wherein said mandrel comprises a concave section disposed at a longitudinal end of said mandrel between an end of said helical trough and an end face of said mandrel.

5. The gun cleaning device of claim 1, wherein said mandrel comprises a frustoconical section disposed at a longitudinal end of said mandrel between an end of said helical trough and an end face of said mandrel.

6. The gun cleaning device of claim 1, wherein said spiral or helical trough comprises a trough selected from the group consisting of a U shaped trough, a V shaped trough, a rectangular shaped, a concave shape, and a rounded shape trough.

7. The gun cleaning device of claim 1, wherein said cable member comprises a coated cable.

8. The gun cleaning device of claim 7, wherein said coated cable comprises a coating selected from the group consisting of nylon, vinyl, and plastic.

9. The gun cleaning device of claim 1, wherein said cable member comprises a steel wire.

10. The gun cleaning device of claim 1, wherein said tubular woven sheath comprises a natural fiber.

11. The gun cleaning device of claim 1, wherein said tubular woven sheath comprises a synthetic fiber.

12. The gun cleaning device of claim 1, wherein said tubular woven sheath comprises a fiber selected from the group consisting of a heat resistant material, a meta-aramid, a para-aramid, a fiberglass, and an aramid fiber.

13. The gun cleaning device of claim 1, wherein said tubular woven sheath comprises a fiber selected from the group consisting of a nylon, a polystyrene, an acetal, an acrylic, a metallic thread, and a brass metallic thread.

14. The gun cleaning device of claim 1, wherein said tubular woven sheath comprises a phosphorescent thread or a luminescent thread.

15. The gun cleaning device of claim 1, further comprising a fitting disposed at one or both ends of said gun cleaning device.

16. The gun cleaning device of claim 15, further comprising a T-handle mechanically coupled to an end of said cable member by said fitting.

17. The gun cleaning device of claim 15, further comprising an accessory swab attachment mechanically coupled to an end of said cable member by said fitting.

18. The gun cleaning device of claim 15, further comprising an accessory brush attachment mechanically coupled to an end of said cable member by said fitting.

19. The gun cleaning device of claim 15, further comprising an accessory scraper attachment mechanically coupled to an end of said cable member by said fitting.

* * * * *